US005678243A

United States Patent [19]

Yang et al.

[11] Patent Number: 5,678,243

[45] Date of Patent: Oct. 14, 1997

[54] PROCESS FOR THE IN-SITU DETOXIFICATION OF AMINOALKYL PHOSPHONOTHIOLATES BY HYDROLYSIS

[75] Inventors: Yu-Chu Yang; John B. Samuel; William T. Beaudry; Linda L. Szafraniec; Dennis K. Rohrbaugh, all of Bel Air, Md.

[73] Assignee: The United States of America as represented by the Secretary of the Army, Washington, D.C.

[21] Appl. No.: 711,840

[22] Filed: Sep. 12, 1996

Related U.S. Application Data

[60] Provisional application No. 60/004,412, Sep. 27, 1995.

[51] Int. Cl. [6] ..... A62D 3/00

[52] U.S. Cl. ..... 588/200; 588/244

[58] Field of Search ..... 588/200, 244

[56] References Cited

U.S. PATENT DOCUMENTS 5,075,297 12/1991 Bannard et al. ..... 514/183

5,584,071 12/1996 Kalyon et al. ..... 588/200

OTHER PUBLICATIONS

Chemical Reactions for Neutralising Chemical Warfare Agents, Yu-Chu Yang, Chemistry & Industry, May 1, 1995, No. 9, pp. 334–337.

Hydrolysis of VX:Activation Energies and Autocatalysis, Yu-Chu Yang, et al, ERDEC-SP-036, May 1996, pp. 375–382.

Hovanec et al, Agent Neutralization Studies III. Detoxification of VX in Aqueous Persulfate, AD-A283-429, 17 pgs.

*Primary Examiner*—Ngoclan Mai

*Attorney, Agent, or Firm*—Ulysses John Biffoni

[57] ABSTRACT

A process for the detoxification or decontamination of aminoalkyl phosphonothiolates and more particularly, the chemical warfare agent VX and its analogs. The process comprises adding water to the chemical agent so that an hydrolysis reaction of the chemical agent with water occurs at specified molar ratios. In a preferred embodiment, the detoxification process is carried out in situ within the chemical agent storage containers in the field and includes mixing the contents of the container after adding the water. The mixing may be accomplished by shaking, rolling, tumbling or pumping.

10 Claims, No Drawings

PROCESS FOR THE IN-SITU DETOXIFICATION OF AMINOALKYL PHOSPHONOTHIOLATES BY HYDROLYSIS

GOVERNMENT INTEREST

The invention described herein may be manufactured, used and licensed by or for the U.S. Government.

This application is a continuation of provisional application number 60/004,412 filed Sep. 27, 1995.

BACKGROUND OF THE INVENTION

1. Field of the Invention

This invention pertains generally to the field of detoxification of aminoalkyl phosphonothiolates and more particularly to detoxification of V-type chemical warfare nerve agents such as VX. In particular, a method is described for the in-situ detoxification of V-type nerve agents through an hydrolysis reaction.

2. Description of the Prior Art

VX and phosphonothiolates are highly toxic chemical nerve agents first synthesized in the mid 1950's. The V-type chemical warfare nerve agents generally comprise methyl phosphonothiolates having an internal amino group. VX is currently stockpiled by the U.S. Army. Although VX has been known for about 40 years, its chemical nature is far more complicated than the phosphonofluoridate esters (the G-agents), and only limited information on the detoxification of bulk quantities of VX exists.

Methods used over the years to decontaminate or detoxify VX have each had problems associated with them such as low solubility of the agent, toxic or corrosive reaction products, and the generation of large amounts of heat over a short reaction period. Most of these prior methods were designed to quickly destroy the agent to prevent exposure to personnel and were typically very exothermic. In addition, each method depends on a solvent other than VX, thereby creating a many fold increase in waste volume. Although incineration does not generate additional waste, environmental concerns exist including the potential for low level agent emissions or spills during handling.

SUMMARY OF THE INVENTION

The present invention provides the only known method of destroying and detoxifying aminoalkyl phosphonothiolates such as V-type chemical warfare nerve agents in-situ, i.e., in their current storage containers. With this new method, VX can be hydrolyzed in its storage container over a period of weeks at ambient temperature resulting in minimal waste generation and no detectable heat of reaction.

It has long been known that small amounts of water cause degradation of VX, however, incomplete hydrolysis leads to a variety of products, some with significant toxicity. In accordance with the present invention, however, VX can be at least 99.9% hydrolyzed using one mole of water per mole of VX (equation 1). The reaction will proceed slowly at ambient temperature where VX poses almost no vapor hazard. In addition, minimal transfer of agent will be required thereby ensuring a reasonably safe process. The reaction products consist primarily of two relatively nontoxic compounds and the waste volume generated will only exceed the initial volume of agent by about 7%. Even if used only as a pretreatment for incineration, this method would greatly reduce handling cost, increase safety, and dramatically reduce the threat of agent emissions.

This degradation process is believed to begin with deprotonation of phosphonic acid impurities by the tertiary amino group of VX. The acid, once deprotonated, acts as a relative nucleophile to attack VX and causes the P-S bond in VX to cleave at ambient temperature. A mixed anhydride (a pyrophosphonate) is produced and subsequently hydrolyzed to ethyl methylphosphonic acid (EMPA) which continues the chain nucleophilic degradation reaction of VX spontaneously. The final products (equation 1), EMPA and diisopropylaminoethanethiol, are relatively nontoxic and are produced quantitatively.

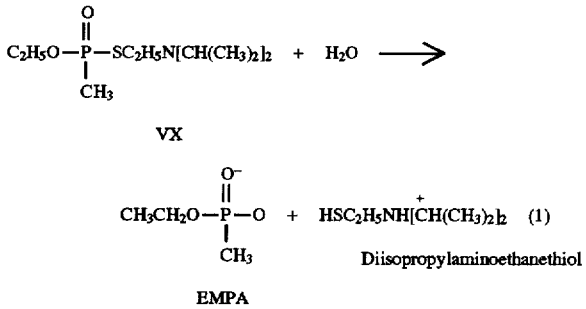

It is then an object of the present invention to provide a method for the in-situ detoxification and/or destruction of aminoalkyl phosphonothiolates.

It is a further object of the present invention to provide a method for the safe detoxification and/or destruction of the chemical warfare agent VX in the agent's current field storage containers.

Other features and advantages of the present invention will be apparent from the following description in which the preferred embodiment has been set forth.

DETAILED DESCRIPTION OF THE PREFERRED EMBODIMENT

The present preferred embodiment of the present invention comprises a process for the in-situ detoxification of the chemical warfare agent VX. First, remove sufficient agent from a VX storage container to allow the addition of about 7 wt % water (water/V-agent=0.07 g/g) to the container. This provides a ratio of one mole water to one mole agent VX in the storage container. Then mix to obtain a single phase. Mixing can be obtained by either shaking, rolling, tumbling or pumping. Finally, simply allow to stand until all agent is destroyed by the hydrolysis reaction. At 25° C. about 8 weeks are required when no additional mixing is provided. It should be noted that 7 wt % water is soluble in VX at 25° C., however, as the reaction proceeds an insoluble product forms that creates a second phase for a week or more. As the reaction proceeds further, the system reverts back to a single phase, however, some additional mixing may be required.

The procedure should be applicable to other aminoalkyl phosphonothiolates which have the same general structure as $$R'P(OR'')(O)(S—(CH_2)_n—NR_2)$$

which is characteristic of a series of V-type nerve agents. Minor adjustments to concentrations, mixing, and reaction times may be necessary and analysis should be made after the reaction is complete to assure adequate decontamination. Adequate mixing and adjusting water concentration to retain the 1:1 mole ratio of agent to water is required. Reaction time and mixing should be adjusted as required based on the analysis.

EXPERIMENTAL AND FULL-SCALE PROCEDURES

A first test was conducted at the laboratory scale. One sample of 1.12 g CASARM (Chemical Agent Standard Analytical Reference Material) grade VX (>95% pure) was mixed with 0.078 ml of distilled water in a small vial by vigorously shaking. About 0.9 ml of the mixture was placed into a graduated, 5 mm outer diameter (o.d.) nuclear magnetic resonance (NMR) tube which was capped and sealed with Parafilm. The mole ratio of VX to water was 1 to 1. A control consisting of VX alone was placed in an identical but dried NMR tube. Samples were analyzed by $^{31}$p NMR and placed in storage at 35° C. No appreciable volume change was noted during the study. The final volume was slightly less (about 1%) than the starting volume. After 24 days, the reaction product was reduced to 0.1% VX as indicated by $^{31}$P NMR and confirmed by gas chromatography-mass spectroscopy (GC-MS). The control purity was 92%.

A second test was also conducted where one sample of 1:1 mole ratio VX:$H_2O$ and a second sample with about 15% excess water were prepared with the same material as in the first test except triple distilled water was used. Both samples were stored in NMR tubes at 25° C. After 47 days, the 1:1 mole ratio sample was at 0.5% VX while the one with excess water was at 0.3% VX.

Next, a test was conducted using munitions grade VX. One sample of 1:1 mole ratio of 92% pure munition grade VX to triple distilled $H_2O$ was prepared as in the previous test along with a second sample containing about 30% excess water. Both samples were stored as before at 25° C. After 37 days, $^{31}$P NMR indicated the sample with excess water was down to 0.1% VX while the sample with 1:1 mole ratio was reduced to 3.7% VX. $^{31}$P NMR analysis also indicated that VX was reduced to about 0.1% VX for the 1 to 1 mole ratio sample after 71 days. The 99.9% destruction of the VX was confirmed by GC-MS.

An analog of VX was also tested in the laboratory and was shown to react in the same manner. One ml of the VX analog Methyl-P(O-butyl)(O)(S—$(CH_2)_2$-N (ethyl)$_2$ was reacted with 8 wt % distilled water at 22° C. After 454 hours the agent was destroyed to below its detectability limit of 20 ppm as indicated by $^{31}$P NMR.

It has also been found that higher temperatures increase the speed of the reaction. For example, 100 g of munitions grade VX of approximately 90 wt % purity was mixed to react with 8.1 g (7.5 wt %) distilled water at 90° C. with stirring in a 200 ml isothermally jacketed glass reactor. Within two hours 99.9% of the VX agent was destroyed as indicated by $^{31}$P NMR.

The present preferred embodiment of the present invention comprises the destruction or detoxification of the agent VX in its ton storage containers. This method has been proven with full-scale testing. More than 1400 lbs of munitions grade VX was reacted with 9.7 wt % water in the ton container in which the VX was stored. The only mixing provided was the injection of the water into the agent. The results indicated that most of the VX was eventually destroyed. The desirability of additional and more thorough mixing was also demonstrated.

The purpose of this invention is to provide a new, easier to use, safer, and more environmentally acceptable means of destroying large quantities of phosphonothiolates than currently exists.

While the invention has been described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

What is claimed is:

1. A process for detoxifying aminoalkyl phosphonothiolates, which comprises:

adding water to said aminoalkyl phosphonothiolate so that said aminoalkyl phosphonothiolate undergoes an hydrolysis reaction.

2. The process of claim 1, wherein about 7 weight percent water is added to the aminoalkyl phosphonothiolate so that a ratio of about one mole water to one mole aminoalkyl phosphonothiolate is maintained.

3. The process of claim 1, wherein said aminoalkyl phosphonothiolate is selected from the group consisting of chemical warfare agent VX and the VX analog Methyl-P (O-butyl)(O)(S—$(CH_2)_2$-N(ethyl)$_2$.

4. The process of claim 1, further comprising:

mixing said water and aminoalkyl phosphonothiolate thereby decreasing the hydrolysis reaction time.

5. The process of claim 4, further comprising:

heating said water and aminoalkyl phosphonothiolate thereby decreasing the hydrolysis reaction time.

6. A process for the detoxification of aminoalkyl phosphonothiolates in their storage containers, which comprises:

adding about 7 weight percent water to said container so that a ratio of about one mole water to one mole aminoalkyl phosphonothiolate is maintained and an hydrolysis reaction occurs.

7. The process of claim 6, further comprising:

first removing sufficient aminoalkyl phosphonothiolate from said storage container to allow the addition of about 7 weight percent water to said container.

8. The process of claim 6, wherein said aminoalkyl phosphonothiolate is selected from the group consisting of the chemical warfare agent VX and the VX analog Methyl-P(O-butyl)(O)(S-$(CH_2)_2$-N (ethyl)$_2$.

9. The process of claim 6, further comprising:

mixing said water and said aminoalkyl phosphonothiolate in said container thereby decreasing the hydrolysis reaction time.

10. The process of claim 9, further comprising:

heating said container thereby decreasing said reaction time.

* * * * *